US005156333A

United States Patent [19]

Worsfold

[11] Patent Number: 5,156,333

[45] Date of Patent: Oct. 20, 1992

[54] APPARATUS FOR PRODUCING FOG

[75] Inventor: Jonathan P. Worsfold, Horsham, England

[73] Assignee: The BOC Group plc, Winclesham, England

[21] Appl. No.: 712,790

[22] Filed: Jun. 10, 1991

[30] Foreign Application Priority Data

Feb. 2, 1991 [GB] United Kingdom ..... 9102277

[51] Int. Cl.[5] ..... A63J 5/02; E01H 13/00

[52] U.S. Cl. ..... 239/2.1; 239/14.1; 239/128; 261/128; 261/DIG. 34; 55/267; 472/65

[58] Field of Search ..... 239/2.1, 14.1, 128, 239/136, 139; 272/15; 128/204.15, 204.16, 204.14; 261/128, 140.1, DIG. 34; 55/80, 267, 269, 387

[56] References Cited

U.S. PATENT DOCUMENTS

| | | | |
|---|---|---|---|
| 1,338,343 | 4/1920 | Weiss et al. | 239/2.1 |
| 1,619,183 | 3/1927 | Bradner et al. | 239/2.1 |
| 1,665,267 | 4/1928 | Jernberg | 239/2.1 |
| 2,070,038 | 2/1937 | Batt | 239/2.1 |
| 2,107,268 | 2/1938 | Avery et al. | 261/DIG. 34 |
| 2,112,392 | 3/1938 | Bichowsky | 261/DIG. 34 |
| 2,154,002 | 4/1939 | Kerrick | 261/DIG. 34 |
| 2,241,522 | 5/1941 | Rice | 128/200.14 |
| 3,654,175 | 4/1972 | Henderson | 239/2.1 |
| 4,836,452 | 6/1989 | Fox | 239/14.1 |

FOREIGN PATENT DOCUMENTS

| | | | |
|---|---|---|---|
| 3604239 | 8/1987 | Fed. Rep. of Germany | 239/2.1 |
| 2592472 | 7/1987 | France | 272/15 |
| 488732 | 7/1938 | United Kingdom | 272/15 |

*Primary Examiner*—Andres Kashnikow
*Assistant Examiner*—Karen B. Merritt
*Attorney, Agent, or Firm*—Carol A. Nemetz; Robert I. Pearlman

[57] ABSTRACT

A method of producing a breathable fog comprises (a) passing air through a dryer unit to remove moisture; (b) cooling the dried air to a temperature below 0° C.; and (c) inducing water vapor into the dried and cooled air to produce breathable fog.

8 Claims, 1 Drawing Sheet

APPARATUS FOR PRODUCING FOG

TECHNICAL FIELD

The present invention relates to apparatus for and a method of producing fog.

BACKGROUND OF THE PRIOR ART

Fog is frequently required for special effects in the production of films or in theatres.

Fog is also used for the analysis of air flows within, for example, "clean rooms" often used by the manufacturers of medical products.

Fog is currently produced using a variety of methods. For example, it is known to produce fog by passing air over solid carbon dioxide to cool the air and then passing the cooled air over the surface of heated water to entrain water vapor and thus create a fog comprising carbon dioxide, water vapor and air.

SUMMARY OF THE INVENTION

It is an aim of the present invention to provide an apparatus for and a method of producing fog which is safe to breath.

According to one aspect of the present invention, a method of producing fog comprises the steps of:

(a) passing air through a drier unit to remove moisture;

(b) cooling the dried air to a temperature below 0° C.; and (c) inducing water vapor into the dried and cooled air to produce a breathable fog.

According to a further aspect of the present invention, an apparatus for producing fog comprises means for directing a flow of air through a drier unit, means for cooling the air located downstream of the drier unit and means for inducing water vapor into the dried and cooled air at a location downstream of the cooling means.

DETAILED DESCRIPTION OF THE INVENTION

Figure 1:
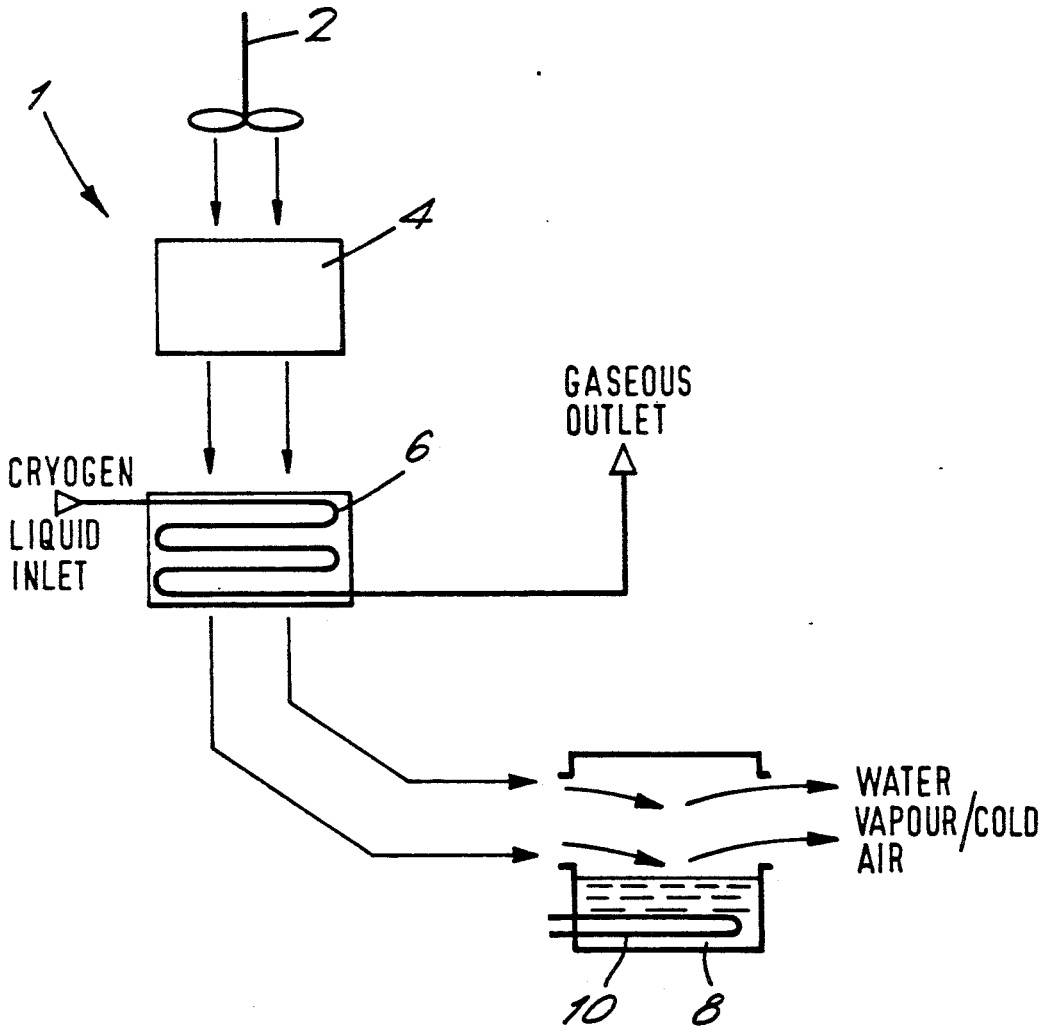
FIG. 1 is a schematic view of an apparatus for producing fog according to the present invention.

As shown in FIG. 1, an apparatus 1 for producing breathable fog includes an electric fan 2 which when operational directs air from a source of uncontaminated air through an air drier unit 4. The dried air on leaving the drier unit 4 is directed by ducting (not shown) towards a heat exchanger 6 through which flows a cryogen, for example, liquid nitrogen.

From the heat exchanger 6 the cooled air is directed again by ducting (not shown) to a water bath or steam generator 8. A heater 10 is located within the water bath 8.

In operation, air from the source is directed by the fan 2 through the air drier unit 4 and hence through the heat exchanger 6. During its passage through the heat exchanger 6 the air is cooled by the liquid nitrogen to a temperature well below freezing point (0° C.) of water.

The cooled air then flows through the water bath 8 in which the water has been heated by means of the heater 10. The passage of the airstream through the water bath entrains water vapor from the surface of the water such that a fog of air and water vapor not deficient in oxygen or enriched by CO2 or nitrogen passes from the water bath to the location where it is to be used.

The air is first passed through the drier unit 4 to prevent any build-up of condensation on the heater exchanger 6. The cold air which entrains vapor from the water bath, as previously explained, will result in a air/water vapor atmosphere which is neither deficient in oxygen or enriched in carbon dioxide or nitrogen and is therefor comfortable to breathe.

Clearly the above described embodiment may be modified in that, for example, other means could be used other than an electric fan for directing the flow of air into the air drier unit 4.

I claim:

1. A method of producing fog comprising the steps of:

(a) passing air through a drier unit to remove moisture;

(b) cooling the dried air to a temperature below 0° C.; and (c) inducing water vapor into the dried and cooled air to produce breathable fog.

2. A method as claimed in claim 1, in which during the cooling step the dried air is passed through a heater exchanger through which flows a cryogen.

3. A method as claimed in claim 2, in which the cryogen is liquid nitrogen.

4. A method as claimed in claim 1, in which during the inducing step the dried and cooled air is passed through a heated water bath.

5. A method as claimed in claim 1, in which during the inducing step the dried and cooled air is passed through a steam generator.

6. An apparatus for producing fog comprising means for directing a stream of air through a drier unit, means for cooling the air to a temperature below 0° C. located downstream of the drier unit and means for inducing water vapor into the air stream located downstream of the cooling means.

7. An apparatus as claimed in claim 6, in which the cooling means is a heat exchanger.

8. An apparatus as claimed in claim 6, in which the inducing means is a water bath in which is located a heater.

* * * * *